US005427635A

United States Patent [19]

Bletton et al.

[11] Patent Number: 5,427,635

[45] Date of Patent: Jun. 27, 1995

[54] MARTENSTITIC STAINLESS STEEL WITH IMPROVED MACHINABILITY

[75] Inventors: Olivier Bletton, Ugine; Jacques Bayol, Gilly-sur-Isere; Pascal Terrien, Albertville, all of France

[73] Assignee: Ugine Savoie, Ugine, France

[21] Appl. No.: 258,926

[22] Filed: Jun. 13, 1994

[30] Foreign Application Priority Data

Jun. 14, 1993 [FR] France ..... 93 07141

[51] Int. Cl.[6] ..... C22C 38/18

[52] U.S. Cl. ..... 148/325; 420/41

[58] Field of Search ..... 148/325; 420/41

[56] References Cited

U.S. PATENT DOCUMENTS 3,690,869 9/1972 Potak et al. ..... 420/41
4,969,963 11/1990 Honkura et al. ..... 420/41
5,362,439 11/1994 Bletton et al. ..... 420/41

FOREIGN PATENT DOCUMENTS 2648477 6/1989 France .
5970748 4/1984 Japan ..... 148/325

*Primary Examiner*—Deborah Yee
*Attorney, Agent, or Firm*—Oblon, Spivak, McClelland, Maier & Neustadt

[57] ABSTRACT

The subject of the invention is a martensitic stainless steel with improved machinability, characterized in that its weight composition is the following:

carbon lower than 1.2%
silicon lower than or equal to 2%
manganese lower than or equal to 2%
chromium: $10.5 \leqq Cr \leqq 19\%$
sulphur lower than or equal to 0.55%
calcium higher than $32 \times 10^{-4}\%$
oxygen higher than $70 \times 10^{-4}\%$
the ratio of the calcium and oxygen content Ca/O being $0.2 \leqq Ca/O \leqq 0.6$, the said steel being subjected to at least one quenching heat treatment to give it a martensitic structure.

8 Claims, 2 Drawing Sheets

MARTENSTITIC STAINLESS STEEL WITH IMPROVED MACHINABILITY

Figure 1:
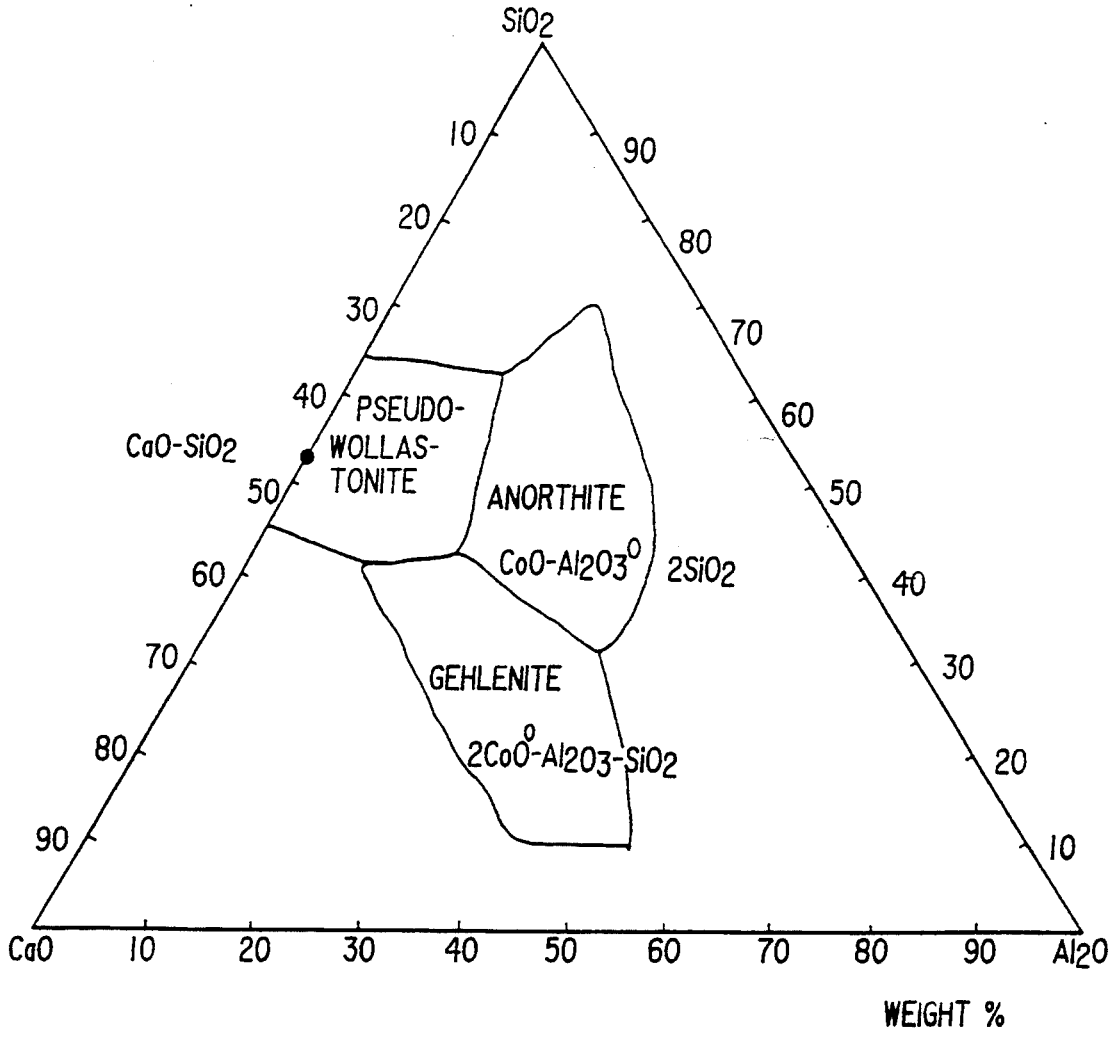

The present invention relates to a stainless steel of the martensitic type with improved machinability.

Iron alloys containing at least 10.5% of chromium are referred to as stainless steels.

Other elements form part of the composition of the steel in order to modify the structure and the properties of the alloys. The four main structures are:

martensitic steels
ferritic steels
austenitic steels
austenoferritic steels.

Martensite steels generally include 12 to 18% of chromium and carbon contents which can range up to approximately 1%. Many alloy elements such as Ni, Mo, Si, Ti, V, Nb, etc. make possible a wide range of properties and result in applications which are as varied as: mechanical construction, tooling, cutlery, oxides when heated, etc.

Their originality is that of combining good corrosion resistance due essentially to the chromium with high mechanical characteristics which are accounted for by the martensitic structure.

There is a vast range of martensitic stainless steels with very varied compositions and use properties. Among the most common grades there may be mentioned:

- the nickel-free carbon-chromium grades. The characteristics sought after are hardness, corrosion resistance and polishability;
- grades containing 16% of chromium plus nickel. The presence of chromium gives them a good corrosion resistance, the nickel (2 to 4%) enables a martensitic structure to be obtained after quenching;
- grades with structural hardening. These have an excellent corrosion resistance with high mechanical characteristics;
- improved 12% chromium grades (addition of elements such as vanadium, molybdenum, tungsten, silicon, niobium, titanium, etc.). The aim is to optimize one or more use properties of the material such as strength when hot, creep, resilience, corrosion resistance, etc.

In all these grades the structure of the final product and its mechanical characteristics depend broadly on the thermal treatments. The three common treatments are quenching, tempering and softening annealing.

The aim of quenching is to give the steel a martensitic structure and a very high hardness.

Tempering makes it possible to increase ductility, which is very low after quenching, and softening annealing makes it possible to obtain a metal that can be subjected to sophisticated processing operations such as certain methods of machining or forming.

All the treatments are defined as a function of the composition of the grade (adjustment of the tempering temperature, of its length, of the type of cooling, etc.).

Martensitic stainless steels are difficult to machine. This state of things is explained by a number of reasons.

In fact, their high hardness causes a mechanical fatigue of the tools, which are subjected to very high cutting stresses and may be taken beyond their break point.

Furthermore, the high frictional forces, added to a mediocre heat conductivity, will give rise to high temperatures at the tool/material interface, resulting in a thermal fatigue and deterioration due to diffusion.

Furthermore, the chip splitting regions are quite often reduced.

Finally, the presence of hard oxides such as alumina or chromite is a factor which worsens wear on cutting tools.

The sources of the wear on tools are therefore different in the case of martensitic steels (high hardness, considerable friction) than in the case of austenitic steels (cold workability, poor heat conductivity, poor chip splitting).

Many routes are employed to improve machinability, but all have disadvantages.

The addition of sulphur, which will form manganese sulphides, which are sometimes chromium-substituted, worsens the corrosion resistance, hot and cold deformability, weldability and the mechanical characteristics in a transverse direction.

The addition of selenium acts as a complement to the sulphur; it tends to globulize the sulphides and as a result improves the mechanical characteristics in a transverse direction. In addiction to the cost, this element is highly toxic.

The addition of tellurium allows, also, to globulize the sulphides, and thus tends to reduce the steel anisotropy particularly the anisotropy of the steel mechanical properties. It also improves, in itself, the machinability but has the disadvantage of reducing the hot-workability. For this reason, its use is restricted.

The addition of lead, which is insoluble in steel, appears in the form of spherical modules, but this element has the disadvantage of being toxic and of worsening forgeability.

A resulphurized austenitic steel with improved machinability, containing in its weight composition a proportion of calcium and of oxygen which improves machinability, is known from FR-A-2,648,477.

Now, it is well known that austenitic stainless steels are difficult to machine, to a large extent because of their low heat conductivity, resulting in poor flow of the heat produced at the point of a cutting tool and rapid deterioration of the tool, and because of their high work-hardenability, giving rise locally to regions of high hardness.

When the steel is being machined, as a result of the high cutting temperatures, these inclusions act as a lubricant at the interface of the steel to be machined and the cutting tool, thus resulting in a reduced wear of the cutting tools and a better surface appearance of the machined articles.

In addition, in the machining field, austenitic steels do not require any extensive thermal treatment that is liable to modify the physicochemical state of the steel and of the inclusions.

Martensitic steels, for their part, are quenchable and one of their characteristics is high hardness. As a result, the problem of the difficulty of machining is not completely solved.

The objective of the invention is to reduce the difficulties encountered in the machining of martensitic steels, while retaining their deformability or hot and cold forgeability properties, their mechanical characteristics and their individual behaviour in heat treatments.

The subject of the invention is a martensitic steel with high machinability, which is characterized by the following weight composition:

carbon lower than 1.2% silicon lower than or equal to 2%
manganese lower than or equal to 2%
chromium: $10.5 \leqq Cr \leqq 19\%$
sulphur lower than or equal to 0.55%
calcium higher than $32 \times 10\%$
oxygen higher than $70 \times 10^{-4}\%$
the ratio of the calcium and oxygen content Ca/O being $0.2 \leqq Ca/O \leqq 0.6$, the said steel being subjected to at least one quenching heat treatment to give it a martensitic structure.

According to other characteristics of the invention:
the steel includes sulphur in a proportion lower than or equal to 0.035%,
the steel includes sulphur in a proportion $0.15\% \leqq S \leqq O0.45\%$, the said steel being resulphurized,
the steel additionally includes nickel in a proportion lower than or equal to 6%,
the steel additionally includes molybdenum in a proportion lower than or equal to 3%,
the steel additionally includes in its weight composition elements chosen from tungsten, cobalt, niobium, titanium, tantalum, zirconium, vanadium and molybdenum in the following proportions by weight:
tungsten lower than or equal to 4%
cobalt lower than or equal to 4.5%
niobium lower than or equal to 1%
titanium lower than or equal to 1%
tantalum lower than or equal to 1%
zirconium lower than or equal to 1%
vanadium lower than or equal to 1%
molybdenum lower than or equal to 3%
the steel includes nickel in a proportion $2\% \leqq Ni \leqq 6\%$ and copper in a proportion $1\% \leqq Cu \leqq 5\%$
the steel contains lime silicoaluminate inclusions of the anorthite and/or pseudowollastonite and/or gehlenite type.

The tests described below and the appended figures will make the invention easier to understand.

Figure 2:
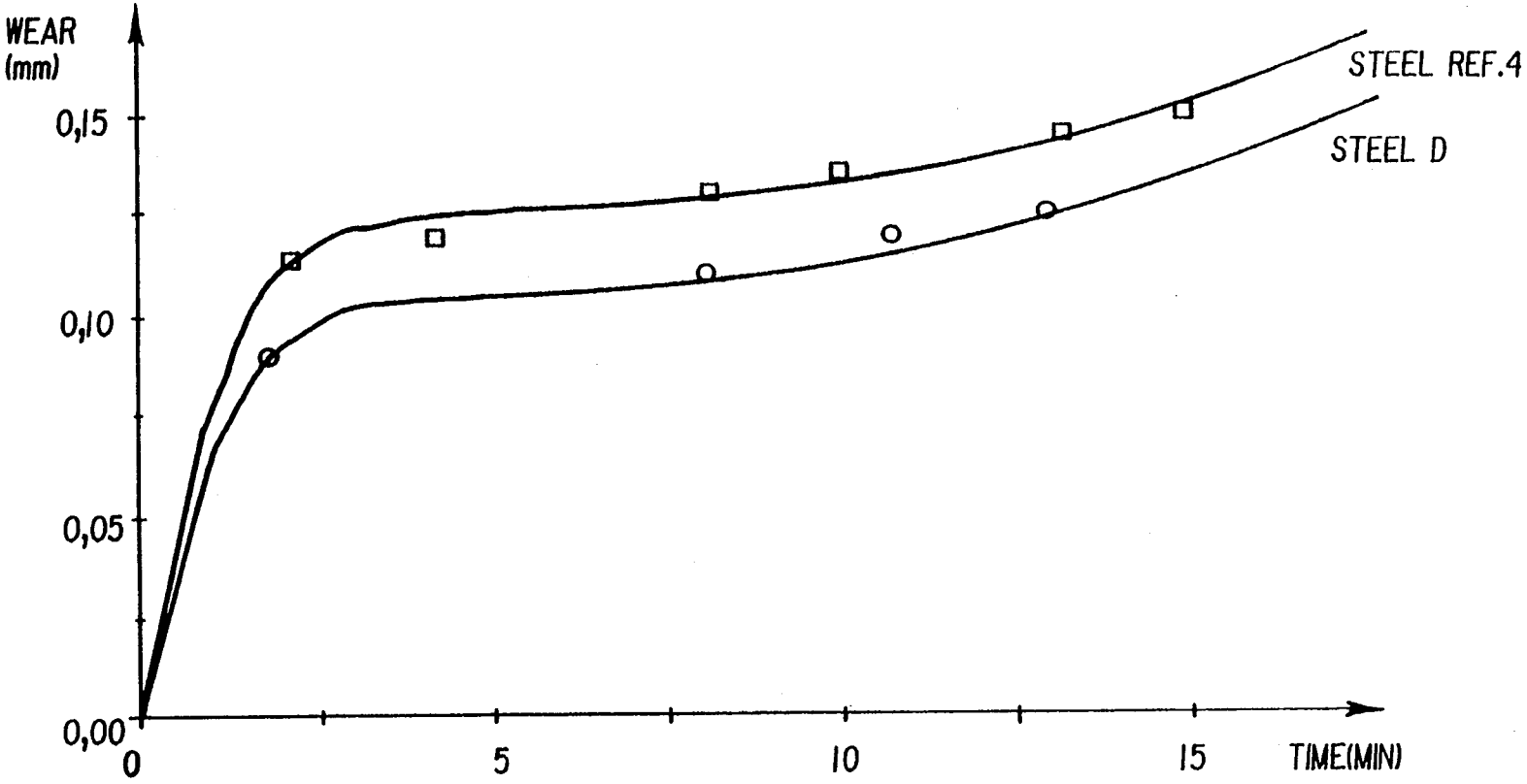

FIG. 1 shows $SiO_2$—CaO—$Al_2O_3$ on a ternary diagram giving the compositions of the oxides introduced into the steel according to the invention, FIG. 2 shows curves representing the change in the wear of a tool for different examples which are given.

Martensitic steels have compositions and above all a structure which are completely different when compared with, for example, austenitic steels. The behaviours of martensitic steels during machining are related to specific problems.

A modification of the composition of martensitic steels does not make it possible to ensure that their properties will be maintained, let alone improved.

Martensitic steels can be quenched and their characterisics include high hardness.

These steels are metallurgically very different from austenitic steels. On the one hand, they can be subjected to quenching and the crystal structure obtained in these steels when cold is not comparable to the austenitic structure.

On the other hand, the production of martensitic steels differs in many ways from that of austenitic steels.

In particular, the heat treatments of the former are numerous and give the metal its use characteristics. The quenching (rapid cooling from a high temperature below a temperature Ms of onset of martensitic transformation, which depends on the steel's composition) enables a martensitic structure to be obtained by starting from an austenitic structure when hot. It is generally followed by a tempering (maintaining at an intermediate temperature depending on the steel) which makes it possible to increase the ductility, which is very low after quenching.

Some grades of martensitic steels undergo softening treatments. The latter are employed when the metal must undergo sophisticated conversion operations such as certain machining or forming methods. The metal structure is then no longer a martensitic structure but a ferritic structure with chromium carbides at the grain boundaries.

However, it recovers its martensitic structure and its mechanical characteristics after appropriate thermal treatments.

Finally, the chemical composition of martensitic steels is very different from that of austenitic steels and this is partly explained, furthermore, by the need to have a sufficiently high temperature Ms of onset of martensitic transformation. They contain only little nickel (less than 6%), and low chromium contents for stainless steels (from 11 to 19% of chromium).

According to the invention the martensitic steel is characterized by its weight composition which is the following:
carbon lower than 1.2%
silicon lower than or equal to 2%
manganese lower than or equal to 2%
chromium: $10.5 \leqq Cr \leqq 19\%$
sulphur lower than or equal to 0.4%
calcium higher than $32 \times 10^{-4}\%$
oxygen higher than $70 \times 10^{-4}\%$
the ratio of the calcium and oxygen content Ca/O being $0.2 \leqq Ca/O \leqq 0.6$, the said steel being subjected to at least one quenching to give it a martensitic structure.

Unexpectedly, when introducing malleable oxides to a martensitic composition, it has been found that the oxides chosen, that is to say lime silicoaluminates of the anorthite and/or pseudowollastonite and/or gehlenite type which are shown in the ternary diagram of FIG. 1, maintain the main properties of the martensitic steel after the thermal treatments which the said steel undergoes, without deterioration in the mechanical properties and while markedly improving the machinability properties.

Now, the inclusions of malleable oxides do not have a favourable effect on machinability merely because the matrix lends itself thereto.

The Applicant Company was surprised to find that in a structure matrix as different as the structure of martensitic steels these oxides also have a beneficial effect on machinability.

Furthermore, it was not obvious that, as a result of the differences in production, the Applicant Company would succeed in obtaining the same type of inclusions in steel.

In particular, the Applicant Company was surprised to find that the nature of the inclusions was not changed in any way by the thermal treatments.

No modification, or at least no significant modification, in the analytical composition of the inclusions is produced, inter alia, by diffusion in the solid state, this being during the thermal treatments to which the martensitic steels are subjected.

The problems of the machining of martensitic steels are furthermore very different from the problems presented by austenitic steels.

In contrast to the latter, they cannot be workhardened and their heat conductivity is not as bad.

On the other hand, the main problem with the machining of martensitic steels is the hardness.

There was no reason whatever to expect that identical inclusions could have a beneficial effect when the reasons for the problems in machining were so different.

It has been found that when martensitic steels are machined, the malleable oxides are sufficiently heated at the machining temperatures of these steels to form a lubricating film which is continuously regenerated by the oxide inclusions present in the metal. This lubricating film makes it possible to reduce the friction of the material on the tool. The effect of the large load due to the high hardness of the material is thus found to be reduced.

Two classes of martensitic steels have been tested, one including sulphur in a proportion of between 0.15 and 0.45% in its weight composition, the other including sulphur in a proportion lower than 0.035% in its weight composition.

It has been observed that the presence of the malleable oxides in the steel does not alter the resistance to corrosion, either pitting or cavity corrosion, both in the case of the low-sulphur composition and in the resulphurized composition.

In general, the gain brought about in machinability is not, in any event, achieved at the expense of characteristics such as forgeability or hot or cold deformability.

It has also been observed that the oxides introduced retain their properties whatever heat treatment performed.

According to the invention the introduction of the malleable oxides is done without taking into account the carbon content to which nitrogen has been added, a decrease in which tends—as has been proved—to lower the mechanical characteristics.

The invention also relates to a martensitic steel to which there has been added, in its weight composition, from 2 to 6% of nickel and from 1 to 5% of copper or else less than 3% of molybdenum.

In steels containing more than 16% of chromium, nickel is necessary in order to obtain a martensitic structure after the quenching.

In so-called structural hardening grade, nickel besides its function referred to above (decrease in the quantity of delta ferrite) will form with copper the "$Ni_3Cu$" phase which will harden the metal. In this case the hardening is not obtained merely by means of the carbon which, moreover, is relatively low.

In combination with the metal, the copper makes it possible to obtain a structural hardening and therefore to increase the mechanical characteristics.

Molybdenum improves corrosion resistance and has a beneficial effect on hardness after tempering and it also improves impact strength.

The martensitic steel according to the invention may also contain stabilizing elements chosen from tungsten, cobalt, niobium, titanium, tantalum and zirconium in the following proportions by weight:

tungsten lower than or equal to 4%
cobalt lower than or equal to 4.5%
niobium lower than or equal to 1%
titanium lower than or equal to 1%
tantalum lower than or equal to 1%
zirconium lower than or equal to 1%.

In an example of application a martensitic steel A according to the invention, the composition of which is the following:

| | C | Si | Mn | Cr | Mo | S | P | N |
|---|---|---|---|---|---|---|---|---|
| STEEL A | 0.205 | 0.462 | 0.52 | 12.34 | 0.041 | 0.024 | 0.022 | 0.046 |

$Ca = 30 \times 10^{-4}\%$
$O = 129 \times 10^{-4}\%$

The ratio of the calcium and oxygen content Ca/O being equal to 0.22.

In this example steel A contains, by way of residue, less than 0.5% of nickel and less than 0.2% of copper.

This steel was compared with two reference steels whose compositions are the following:

| | C | Si | Mn | Ni | Cr | Mo | Cu | S | P | N |
|---|---|---|---|---|---|---|---|---|---|---|
| Ref. 1 | 0.184 | 0.359 | 0.530 | 0.180 | 12.63 | 0.135 | 0.084 | 0.022 | 0.018 | 0.056 |
| Ref. 2 | 0.194 | 0.364 | 0.731 | 0.313 | 12.77 | 0.093 | 0.088 | 0.002 | 0.017 | 0.049 |

The three steels were subjected to tests for turning machinability.

The turning is performed with solid carbide tips, a test denoted by Vb 30/0.3, which consists in determining the speed at which the flank wear is 0.3 mm after 30 min. of machining and also, with coated carbide tips, a test denoted by Vb 15/0.15 which consists in determining the speed at which the flank wear is 0.15 mm after 15 min. of machining.

It is found in Table 1 below that the mechanical properties are not altered in any way by the introduction of malleable oxide inclusions for two thermal softening treatments, that is to say comprising a quenching with oil at 950° C., a hold for four hours at 820° C., a slow cooling to 650° C. and then a cooling with air and "treated", that is to say having undergone a quenching at 950° C., a tempering at 640° C. and a cooling in air.

TABLE 1

| | GRADE | THERMAL TREATMENT | Rm MPa | Rp 0.2 MPa | A % | Z % | HARDNESS HRB/HRC |
|---|---|---|---|---|---|---|---|
| INV | A | SOFTENED | 535 | 282 | 29 | 82 | |
| REF | 2 | SOFTENED | 544 | 296 | 29.2 | 64.1 | 82.3 HBR |
| REF | 1 | SOFTENED | 544 | 280 | 28.6 | 60.6 | 80.6 HRB |
| INV | A | TREATED | 858 | 737 | 14 | 51 | |
| REF | 2 | TREATED | 967 | 837 | 12 | 52.6 | 29.1 HRC |
| REF | 1 | TREATED | 899 | 754 | 15.5 | 55.8 | 27.3 HRC |

The tests have shown that the so-called "treated" steels are machined better than the softened steels.

In another example of application, a martensitic steel according to the invention and whose weight composition is only the following:

| | C | Si | Mn | Cr | Mo | 9 | P | N | Ca | O | Ca/O |
|---|---|---|---|---|---|---|---|---|---|---|---|
| STEEL B | 0.196 | 0.444 | 0.555 | 12.10 | 0.073 | 0.0263 | 0.019 | 0.053 | $41 \times 10^{-4}$ | $99 \times 10^{-4}$ | 0.41 |

In this example, steel B contains, by way of residue, less than 0.5% of nickel and less than 0.2% of copper.

This steel is compared with a reference standard steel containing no malleable oxides in its composition and the composition of which is the following:

| | C | Si | Mn | Ni | Cr | Mo | Cu | S | P | N | Ca | O | Ca/O |
|---|---|---|---|---|---|---|---|---|---|---|---|---|---|
| REF 3 | 0.214 | 0.344 | 0.564 | 0.354 | 12.32 | 0.097 | 0.106 | 0.261 | 0.017 | 0.054 | | $45 \times 10^{-4}$ | |

In Table 2 below it is noted that the mechanical characteristics compared between the reference steel 3 and the steel B according to the invention show no significant differences both in the case of a softened and a treated state.

TABLE 2

| | REF. 3 | | STEEL B | |
|---|---|---|---|---|
| | SOFTENED | TREATED | SOFTENED | TREATED |
| Rm(MPa) | 559 | 803 | 566 | 787 |
| Rp 0.2(MPa) | 418 | 636 | 408 | 600 |
| A % | 29 | 18.7 | 29 | 19 |
| Z % | 67.5 | 60.5 | 67 | 63 |

Table 3 below shows characteristic values for the machining tests and shows that the treated steels according to the invention give a machinability gain of to 30%.

TABLE 3

| | METALLURGICAL STATE | | | |
|---|---|---|---|---|
| | TREATED | | SOFTENED | |
| | test: | | | |
| | Vb 30/0.3 (m/min) | Vb 15/0.15 (m/min) | Vb 30/0.3 (m/min) | Vb 15/0.15 (m/min) |
| Steel ref. 1 | 195 | 250 | — | — |
| Steel ref. 2 | 150 | 205 | — | — |
| Steel ref. 3 | 230 | 250 | 200 | 220 |
| Steel A | 250 | — | — | — |
| Steel B | 250 | 290 | — | — |

In a third example of application, two martensitic steels C and D according to the invention, the compositions of which are the following:

Steels C and D were compared with reference steels containing no malleable oxides and the weight compositions of which are the following:

| | C | Si | Mn | Ni | Cr | Mo | Cu | P | N | Nb | $S \times 10^{-4}$ | $Ca \times 10^{-4}$ | $O \times 10^{-4}$ |
|---|---|---|---|---|---|---|---|---|---|---|---|---|---|
| Ref. 4 | 0.011 | 0.45 | 0.815 | 4.548 | 15.26 | 0.006 | 3.245 | 0.011 | 0.017 | 0.182 | 270 | <5 | 138 |
| Ref. 5 | 0.013 | 0.405 | 0.878 | 4.509 | 15.26 | 0.006 | 3.228 | 0.011 | 0.016 | 0.202 | 110 | <5 | 48 |

These reference steels contain copper and nickel in their composition and form part of the grades with structural hardening.

Three metallurgical states corresponding to different thermal treatments are commonly encountered:

the quenched state: oil quenching at 1050° C. then tempering at 250° C. Rm≈1000 MPa, the aged state in which the metal has its maximum hardness: 1050° C. quenching then tempering at about 450° C. Rm≈1400 MPa softened state: 1050° C. quenching, tempering at 760° C. for 4 hours, second tempering at about 620° C. Rm 900 MPa The special feature of grades of this type is that it does not undergo dimensional changes as a result of the heat treatments. It can therefore be machined and then aged.

Steel D according to the invention was treated by machining in the quenched state. This is to say that it underwent a quenching at 1050° C. in oil. As shown in the curves of FIG. 2, it became apparent that the presence of malleable oxides did improve the machinability, which can be ascertained on the curves by the decrease in the tool wear. This wear changes, in fact, from 0.15 mm after 15 min. of machining at a speed of 190 m/min., an advance of 0.15 mm/turn, a pass depth of 1.5 mm for reference steel 4, to a wear of 0.125 mm for steel D.

Steel D according to the invention made it possible to obtain in the softened state a cutting speed of 240 m/min. whereas reference steel 5 made possible a cutting speed of 210 m/min. The recorded gain is 20%.

These various examples of application clearly demonstrate that the martensitic steels containing malleable oxides in their composition have an improved machin-

| | C | Si | Mn | Ni | Cr | Mo | Cu | P | N | Nb | $S \times 10^{-4}$ | $Ca \times 10^{-4}$ | $O \times 10^{-4}$ |
|---|---|---|---|---|---|---|---|---|---|---|---|---|---|
| Steel C | 0.018 | 0.443 | 0.825 | 4.517 | 15.2 | 0.005 | 3.189 | 0.01 | 0.018 | 0.202 | 110 | 65 | 132 |
| Steel D | 0.012 | 0.448 | 0.818 | 3.739 | 15.37 | 0.005 | 3.236 | 0.01 | 0.021 | 0.192 | 233 | 70 | 157 |

ability, while the oxides do not degrade the other characteristics of the said steels.

We claim:

1. Martensitic stainless steel with improved machinability, characterized in that its weight composition is the following:

carbon lower than 1.2% silicon lower than or equal to 2% manganese lower than or equal to 2% chromium: $10.5 \leqq Cr \leqq 19\%$ sulphur lower than or equal to 0.55% calcium higher than $32 \times 10^{-4}\%$ oxygen higher than $70 \times 10^{-4}\%$ the ratio of the calcium and oxygen content Ca/O being $0.2 \leqq Ca/O \leqq 0.6$, the said steel being subjected to at least one quenching thermal treatment to give it a martensitic structure.

2. Steel according to claim 1, characterized in that it includes sulphur in a proportion lower than or equal to 0.035%.

3. Steel according to claim 1, characterized in that it includes sulphur in a proportion of $0.15\% \leqq S \leqq 0.45\%$, the said steel being resulphurized.

4. Steel according to any one of claims 1 to 3, characterized in that it additionally includes nickel in a proportion lower than or equal to 6%.

5. Steel according to any one of claims 1 to 4, characterized in that it additionally includes molybdenum in a proportion lower than or equal to 3%.

6. Steel according to any one of claims 1 to 3, characterized in that it additionally includes in its weight composition elements chosen from tungsten, cobalt, niobium, titanium, tantalum, zirconium, vanadium and molybdenum in the following proportions by weight:

tungsten lower than or equal to 4% cobalt lower than or equal to 4.5% niobium lower than or equal to 1% titanium lower than or equal to 1% tantalum lower than or equal to 1% zirconium lower than or equal to 1% vanadium lower than or equal to 1% molybdenum lower than or equal to 3%.

7. Steel according to claim 6, characterized in that it includes nickel in a proportion of $2\% \leqq Ni \leqq 6\%$ and copper in a proportion of $1\% \leqq Cu \leqq 5\%$.

8. Steel according to any one of claims 1 to 7, characterized in that it contains lime silicoaluminate inclusions of the anorthite and/or pseudowollastonite and/or gehlenite type.

* * * * *

UNITED STATES PATENT AND TRADEMARK OFFICE

CERTIFICATE OF CORRECTION

PATENT NO. : 5,427,635

DATED : June 27, 1995

INVENTOR(S) : Olivier BLETTON, et al.

It is certified that error appears in the above-indentified patent and that said Letters Patent is hereby corrected as shown below:

On the title page, Item [54], and Column 1, Lines 2 and 3, the title should read:

--MARTENSITIC STAINLESS STEEL WITH IMPROVED MACHINABILITY--

Signed and Sealed this

Fifteenth Day of August, 1995

*Attest:*

Bruce Lehman

BRUCE LEHMAN

*Attesting Officer*

*Commissioner of Patents and Trademarks*